US006413375B2

(12) United States Patent
Böck et al.

(10) Patent No.: US 6,413,375 B2
(45) Date of Patent: Jul. 2, 2002

(54) PAPER MACHINE

(75) Inventors: Karl Josef Böck, Heidenheim; Gerhard Kotitschke, Steinheim; Johann Moser, Heidenheim, all of (DE)

(73) Assignee: Voith Paper Patent GmbH of Heidenheim (DE)

( * ) Notice: Subject to any disclaimer, the term of this patent is extended or adjusted under 35 U.S.C. 154(b) by 0 days.

(21) Appl. No.: 09/778,077

(22) Filed: Feb. 7, 2001

(30) Foreign Application Priority Data

Apr. 4, 2000 (DE) ..... 100 16 754

(51) Int. Cl.[7] ..... D21F 7/00

(52) U.S. Cl. ..... 162/286; 162/358.1; 162/194

(58) Field of Search ..... 162/109, 115, 162/120, 191, 193, 194, 195, 204, 205, 255, 260, 264, 272, 286, 353, 358.1; 34/108, 110, 111, 116, 117, 120

(56) References Cited

U.S. PATENT DOCUMENTS

| | | | | | |
|---|---|---|---|---|---|
| 1,279,756 | A | * | 9/1918 | Pope | 162/193 |
| 1,761,051 | A | * | 6/1930 | Rivard | 162/194 |
| 2,714,342 | A | | 8/1955 | Beachler | 162/370 |
| 3,405,031 | A | * | 10/1968 | Sisson | 162/195 |
| 4,904,344 | A | * | 2/1990 | Peiffer | 162/193 |
| 5,185,063 | A | * | 2/1993 | Aula et al. | 162/193 |
| 5,234,549 | A | * | 8/1993 | Weldon | 162/193 |
| 5,248,390 | A | * | 9/1993 | Fissmann et al. | 162/193 |
| 5,423,947 | A | * | 6/1995 | Steiner et al. | 162/286 |
| 5,507,916 | A | * | 4/1996 | Schiel | 162/195 |
| 6,001,219 | A | * | 12/1999 | Caspar | 162/286 |
| 6,022,452 | A | * | 2/2000 | Caspar | 162/286 |
| 6,207,016 | B1 | * | 3/2001 | Ekstrom | 162/194 |

FOREIGN PATENT DOCUMENTS

| | | | |
|---|---|---|---|
| DE | 2031609 | 1/1972 | D21F/7/00 |
| DE | 4234449 | 3/1993 | |
| DE | 4222034 | 1/1994 | |
| DE | 4037166 | 12/1999 | |

* cited by examiner

*Primary Examiner*—Peter Chin
*Assistant Examiner*—Eric Hug
(74) *Attorney, Agent, or Firm*—Greenblum & Bernstein, P.L.C.

(57) ABSTRACT

Machine for producing a web includes a former for sheet formation of the web, a press section for dewatering the web, a drying section for drying the web, and at least one edge strip forming device positioned in an area of at least one of the press section and the drying section, which is arranged to separate at least one edge strip from the web.

33 Claims, 1 Drawing Sheet

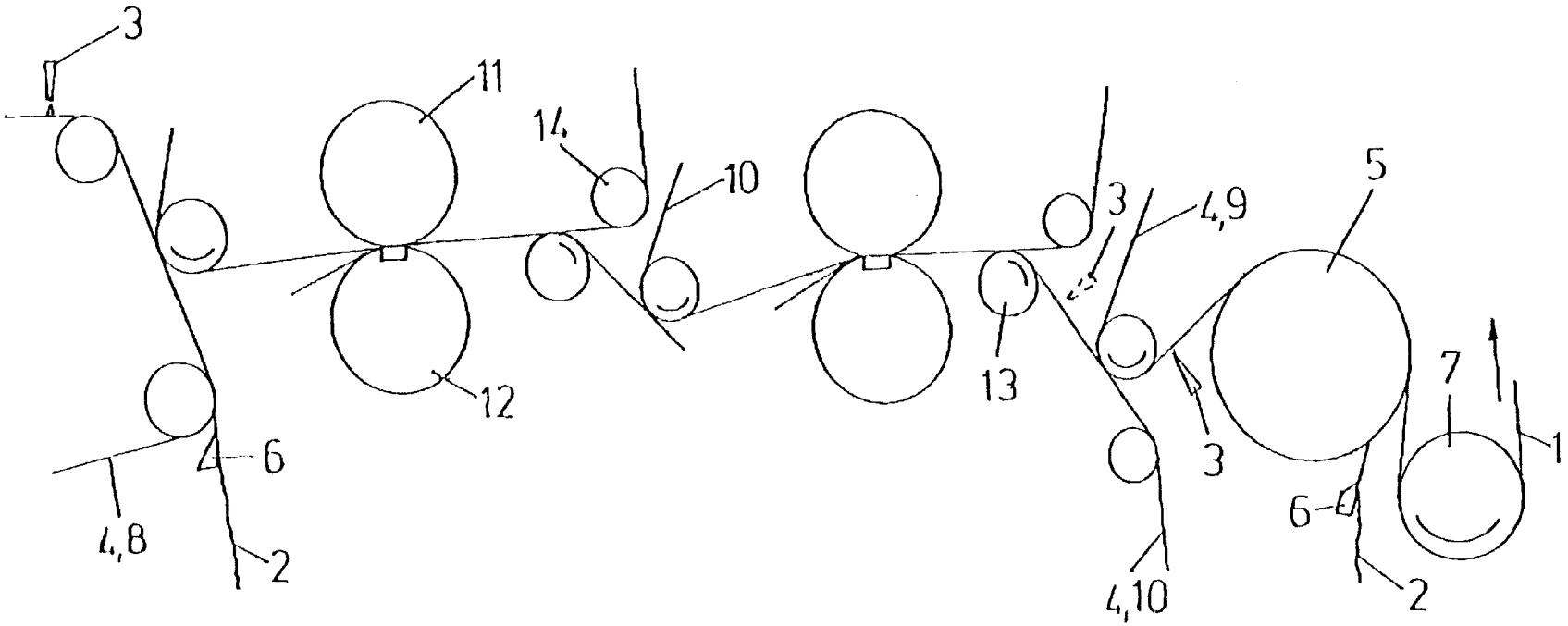
1
7
2
5
6
3
4,9
4,10
3
13
10
14
11
12
6
2
3
4,8

PAPER MACHINE

CROSS-REFERENCE TO RELATED APPLICATIONS

The present application claims priority under 35 U.S.C. §119 of German Patent Application No. 100 16 754.3, filed on Apr. 4, 2000, the disclosure of which is expressly incorporated by reference herein in its entirety.

BACKGROUND OF THE INVENTION

1. Field of the Invention

The invention relates to a paper machine for producing a paper web with a former for sheet creation, a subsequent press section for dewatering, and a subsequent drying section for drying the paper web.

2. Discussion of Background Information

In the former of a paper machine it is generally customary to separate and remove an edge strip on each side. This serves to create clean, straight web edges which is an essential element for winding the paper web at the end of the paper machine. In the sections of the paper machine in between, much is done to maintain the quality of the web edges. In order to counteract the formation of folds as well as tears and rips, a guidance of the paper web as closed as possible, i.e., continuously, by a belt or a roll is desired. In particular with thin papers, certain press sections, and/or higher speeds, difficulties increasingly arise with regard to a stable web guidance. Here, the quality of the paper web is considerably influenced by edge separation or web flapping.

SUMMARY OF THE INVENTION

Therefore, the present invention ensures a good quality of the web edges at the end of the paper machine with the least possible expense.

The instant invention provides that, at least in the area of the press section and/or the drying section, preferably on both sides, at least one edge strip is separated and removed from the paper web. This allows the edge strips to be arranged according to endangered areas (with regard to a stable web guidance). This results in the possibility of limiting or even reducing the measures for ensuring a stable web guidance and also of ensuring clean and straight web edges at the end of the paper machine even in difficult circumstances (low basis weight, high speed, etc.)

Since energy is increasingly introduced into the production process of the paper web it is desirable to perform the separation of the edge strips as soon as possible and to introduce the edge strips into a pulper for recycling. For this reason, the edge strips should be separated and removed at the end of the press section, at the beginning of the drying section, or therebetween.

However, it can be advantageous for the glazing process to separate and remove the edge strips at the end of the drying section or behind it, i.e., in front of the glazing unit of the paper machine.

In addition, one edge strip each can still be separated and removed from the paper web in the former as well. In general, this first edge trimming should be larger than the subsequent one. However, for the purpose of limiting the expense, it is also possible to omit the edge trimming in the former.

The separation of edge strips from the paper web should occur by way of water jet devices with the paper web being supported by a belt, in particular in the form of a wire or a felt, or a roll. However, due to the high pressure of water jet devices it is generally advantageous for the paper web to travel without support during the separation of the edge strips since otherwise damages are to be expected to the belt or the roll. The removal of the edge strip should be supported by at least one scraper or similarly operating element which preferably guides the edge strips into the machine base.

The present invention is directed to a machine for producing a web. The machine includes a former for sheet formation of the web, a press section for dewatering the web, a drying section for drying the web, and at least one edge strip forming device positioned in an area of at least one of the press section and the drying section, which is arranged to separate at least one edge strip from the web.

In accordance with a feature of the instant invention, the machine can include at least one edge strip removing device positioned in an area of at least one of the press section and the drying section, which is arranged to remove the at least one edge strip separated from the web. The web may include a paper web and the machine is a paper machine.

Further, the at least one edge strip forming device may be arranged to separate the at least one edge strip from the web at an end of the press section, and the at least one edge strip removing device may be arranged to remove the at least one edge strip from the web at the end of the press section.

Still further, the at least one edge strip forming device can be arranged to separate the at least one edge strip from the web at a beginning of the dewatering section, and the at least one edge strip removing device can be arranged to remove the at least one edge strip from the web at the beginning of the dewatering section.

Moreover, the at least one edge strip forming device can be arranged to separate the at least one edge strip from the web at one of an end of the drying section or downstream of the drying section, and the at least one edge strip removing device can be arranged to remove the at least one edge strip from the web at the one of the end of the drying section or downstream of the drying section.

The at least one edge strip removing device may include at least one scraper. The at least one scraper may be arranged to guide the at least one edge strip into a machine base.

In accordance with another feature of the invention, an edge strip forming device may be positioned in the former, which is arranged to separate an edge strip from each side of the web, and an edge strip removing device may be positioned in the former, which is arranged to remove the edge strip separated from each side of the web.

According to still another feature of the present invention, wherein the at least one edge strip forming device may include a waterjet device. The at least one edge strip device can be arranged such that, during separation, a separation point of the at least one edge strip from the web is supported by one of a belt and a roll. Further, the belt can include at least one of a wire and a felt. The at least one edge strip device may be arranged such that, during separation, a separation point of the at least one edge strip from the web is not supported.

The present invention is directed to an apparatus for producing a web. The apparatus includes a former for sheet formation of the web, a press section for dewatering the web, a drying section for drying the web, at least one edge strip forming device positioned in an area of at least one of the press section and the drying section, which is arranged to separate at least one edge strip from the web, and at least one edge strip removing device comprising a doctor positioned in an area of at least one of the press section and the drying section, which is arranged to remove the at least one edge strip separated from the web.

The present invention is directed to a process of producing a web in an apparatus that includes a former, a press section, a drying section, and at least one edge strip forming device positioned in an area of at least one of the press section and the drying section. The process includes forming the web on the former, dewatering the web in the press section, drying the web in the drying section, and separating, with the at least one edge strip forming device, at least one edge strip from the web in the at least one of the press section and the drying section.

In accordance with a feature of the invention, the apparatus may further include at least one edge strip removing device positioned in an area of at least one of the press section and the drying section, and the process can further include removing, with the at least one edge strip removing device, the at least one edge strip separated from the web in the at least one of the press section and the drying section.

Further, the at least one edge strip forming device and the at least one edge strip removing device may be positioned at an end of the press section, and process can further include separating, with the at least one edge strip forming device, the at least one edge strip from the web at the end of the press section, and removing, with the at least one edge strip removing device, the at least one edge strip separated from the web at the end of the press section.

Still further, the at least one edge strip forming device and the at least one edge strip removing device can be positioned at a beginning of the dewatering section, and process may further include separating, with the at least one edge strip forming device, the at least one edge strip from the web at the beginning of the dewatering section, and removing, with the at least one edge strip removing device, the at least one edge strip separated from the web at the beginning of the dewatering section.

Moreover, the at least one edge strip forming device and the at least one edge strip removing device can be positioned at one of an end of the dryer section or downstream of the dryer section, and process can further include separating, with the at least one edge strip forming device, the at least one edge strip from the web at the one of the end of the dryer section or downstream of the dryer section, and removing, with the at least one edge strip removing device, the at least one edge strip separated from the web at the one of the end of the dryer section or downstream of the dryer section.

The at least one edge strip removing device can include at least one scraper and the process can further include guiding the at least one edge strip into a machine base with the at least one scraper.

In accordance with another feature of the present invention, the apparatus may further include an edge strip forming device and an edge strip removing device positioned in the former, and the process can further include separating an edge strip from each side of the web with the edge strip forming device in the former, and removing the edge strip separated from each side of the web in the former.

According to still another feature of the invention, during separation, a separation point of the at least one edge strip from the web may be supported by one of a belt and a roll.

In accordance with yet another feature of the instant invention, the web may be supported by one of a belt and a roll from the former section through the dryer section.

The present invention is directed to a process of producing a web in an apparatus that includes a former, a press section, and a drying section. The process includes forming the web on the former, dewatering the web in the press section, drying the web in the drying section, and separating at least one edge strip from the web in at least one of the press section and the drying section.

Further, the process may include removing the at least one edge strip separated from the web in the at least one of the press section and the drying section.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of a non-limiting example of an exemplary embodiment of the present invention, and wherein:

The Figure depicts a schematic cross section through a press section, the end of a former positioned in front of it, and the beginning of a subsequent drying section.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than necessary for the fundamental understanding of the present invention, the description taken with the drawings making apparent to those skilled in the art how the several forms of the present invention may be embodied in practice.

The so-called sheet formation occurs in the former with the paper web 1 being supported by a belt 4 in the form of a former wire 8. Here, at the end of the former, one edge strip 2 each is separated from the paper web 1 using water jet devices 3 positioned on both sides of the paper web 1. Subsequently, the edge strips 2 are lifted off the former wire 8 by a scraper 6 and are guided to the pulper in the machine base. The water jet devices 3 have at least one jet that directs a water jet onto the paper web 1 at a relatively high pressure.

The paper web 1 is transferred from the former wire 8 to a press felt 10 of the subsequent press section. Here, for the purpose of dewatering the paper web 1, it is guided through two press nips along with the press felt 10 provided at each side of the paper web 1. The press nips are each formed by two press rolls 11, 12 pressing against one another, with each press roll 11, 12 having its own continuously circulating press felt 10 guided by-guidance rolls 14 and suctioned guidance rolls 13. At the end of the press section, the use of water jet devices 3 for separation of additional edge strips 2 is sketched in the figure.

The paper web 1 is transferred from the lower press felt 10 of the last press nip to a belt 4 in the form of a drying wire 9 of the drying section. In the drying section, the paper web 1 is guided along with at least one drying wire 9 over heated drying cylinders 5 and suctioned guidance rolls 7 for drying. Instead of the lower press felt 10 of the last press nip, the use of a smooth, non-permeable transfer belt can be advantageous as well.

In order to eliminate damages to the web edges caused in the press section by the formation of folds or by web flapping, another edge strip 2 each is separated on both sides at the beginning of the drying section. This occurs via water jet devices 3 which are directed toward the belt 4, i.e., the drying wire 9. Then the edge strips wrap around the first drying cylinder 5 from which they are then lifted off by a scraper 6 and guided into the machine base.

From the end of the former to the beginning of the drying section, the paper web 1 is continuously guided by at least one belt 4 or a roll. This closed guidance allows high machine speeds, with edge problems being irrelevant due to the additional edge separation behind the former.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope of the present invention in its aspects. Although the present invention has been described herein with reference to particular means, material and embodiments, the present invention is not intended to be limited to the particulars disclosed herein; rather, the present invention extends to all functionally equivalent structures, methods, and uses, such as are within the scope of the appended claims.

What is claimed:

1. A machine for producing a web, comprising:

a former for sheet formation of the web;

a press section for dewatering the web;

a drying section for drying the web;

at least one edge strip forming device positioned in an area of at least one of said press section and said drying section, which is arranged to separate at least one edge strip from the web;

at least one edge strip removing device arranged to remove said at least one edge strip separated by said at least one edge strip forming device positioned in an area of said at least one of said press section and said drying section; and at least one additional edge forming device positioned in said former.

2. The machine in accordance with claim 1, wherein the web comprises a paper web and the machine is a paper machine.

3. The machine in accordance with claim 1, wherein said at least one additional edge forming device is arranged to separate an edge strip from each side of the web, and said machine further comprises:

an edge strip removing device positioned in said former, which is arranged to remove said edge strip separated from each side of the web.

4. The machine in accordance with claim 1, wherein said at least one edge strip forming device comprises a water jet device.

5. The machine in accordance with claim 4, wherein said at least one edge strip device is arranged such that, during separation, a separation point of the at least one edge strip from the web is supported by one of a belt and a roll.

6. The machine in accordance with claim 5, wherein said belt comprises at least one of a wire and a felt.

7. The machine in accordance with claim 4, wherein said at least one edge strip device is arranged such that, during separation, a separation point of the at least one edge strip from the web is not supported.

8. A machine for producing a web, comprising:

a former for sheet formation of the web;

a press section for dewatering the web;

a drying section for drying the web;

at least one edge strip forming device positioned in an area of at least one of said press section and said drying section, which is arranged to separate at least one edge strip from the web;

at least one additional edge forming device positioned in said former; and at least one edge strip removing device positioned in an area of at least one of said press section and said drying section, which is arranged to remove the at least one edge strip separated from the web.

9. The machine in accordance with claim 8, wherein said at least one edge strip forming device is arranged to separate the at least one edge strip from the web at an end of said press section, and said at least one edge strip removing device is arranged to remove the at least one edge strip from the web at said end of said press section.

10. The machine in accordance with claim 8, wherein said at least one edge strip forming device is arranged to separate the at least one edge strip from the web at a beginning of said drying section, and said at least one edge strip removing device is arranged to remove the at least one edge strip from the web at said beginning of said drying section.

11. The machine in accordance with claim 8, wherein said at least one edge strip forming device is arranged to separate the at least one edge strip from the web at one of an end of said drying section or downstream of said drying section, and said at least one edge strip removing device is arranged to remove the at least one edge strip from the web at said one of said end of said drying section or downstream of said drying section.

12. The machine in accordance with claim 8, wherein said at least one edge strip removing device comprises at least one scraper.

13. The machine in accordance with claim 12, wherein said at least one scraper is arranged to guide the at least one edge strip into a machine base.

14. An apparatus for producing a web, comprising:

a former for sheet formation of the web;

a press section for dewatering the web;

a drying section for drying the web;

at least one edge strip forming device positioned in an area of at least one of said press section and said drying section, which is arranged to separate at least one edge strip from the web;

at least one edge strip removing device comprising a doctor positioned in an area of at least one of said press section and said drying section, which is arranged to remove the at least one edge strip separated from the web; and at least one additional edge strip forming device positioned in said former.

15. A process of producing a web in an apparatus that includes a former, a press section, and a drying section, the process comprising:

forming the web on the former;

dewatering the web in the press section;

drying the web in the drying section;

separating at least one edge strip from the web in at least one of the press section and the drying section;

removing the at least one edge strip separated in the at least one of the press section and the drying section; and separating at least one additional edge strip from the web in the former.

16. The process in accordance with claim 15, further comprising:

removing the at least one edge strip separated from the web in the at least one of the press section and the drying section.

17. A process of producing a web in an apparatus that includes a former, a press section, a drying section, at least one edge strip forming device positioned in an area of at least one of the press section and the drying section, and at least one additional edge strip forming device positioned in the former, the process comprising:

forming the web on the former;

dewatering the web in the press section;

drying the web in the drying section;

separating, with the at least one edge strip forming device, at least one edge strip from the web in the at least one of the press section and the drying section;

removing the at least one edge strip separated by the at least one edge strip forming device; and separating, with the at least one additional edge strip forming device, at least one additional edge strip from the web in the former.

18. The process in accordance with claim 17, wherein the apparatus further includes an edge strip removing device positioned in the former, and the process further comprises:

separating an edge strip from each side of the web with the at least one additional edge forming device in the former; and removing the edge strip separated from each side of the web in the former.

19. The process in accordance with claim 17, wherein, during separation, a separation point of the at least one edge strip from the web is supported by one of a belt and a roll.

20. The process in accordance with claim 17, wherein the web is supported by one of a belt and a roll from the former section through the dryer section.

21. A process of producing a web in an apparatus that includes a former, a press section, a drying section, at least one edge strip forming device positioned in an area of at least one of the press section and the drying section, at least one additional edge strip forming device positioned in the former, and at least one edge strip removing device positioned in an area of at least one of said press section and said drying section, the process comprising:

forming the web on the former;

dewatering the web in the press section;

drying the web in the drying section;

separating, with the at least one edge strip forming device, at least one edge strip from the web in the at least one of the press section and the drying section; and separating, with the at least one additional edge strip forming device, at least one additional edge strip from the web in the former; and removing, with the at least one edge strip removing device, the at least one edge strip separated from the web in the at least one of the press section and the drying section.

22. The process in accordance with claim 21, wherein the at least one edge strip forming device and the at least one edge strip removing device is positioned at an end of the press section, and process further comprises:

separating, with the at least one edge strip forming device, the at least one edge strip from the web at the end of the press section; and removing, with the at least one edge strip removing device, the at least one edge strip separated from the web at the end of the press section.

23. The process in accordance with claim 21, wherein the at least one edge strip forming device and the at least one edge strip removing device is positioned at a beginning of the drying section, and process further comprises:

separating, with the at least one edge strip forming device, the at least one edge strip from the web at the beginning of the drying section; and removing, with the at least one edge strip removing device, the at least one edge strip separated from the web at the beginning of the drying section.

24. The process in accordance with claim 21, wherein the at least one edge strip forming device and the at least one edge strip removing device is positioned at one of an end of the dryer section or downstream of the dryer section, and process further comprises:

separating, with the at least one edge strip forming device, the at least one edge strip from the web at the one of the end of the dryer section or downstream of the dryer section; and removing, with the at least one edge strip removing device, the at least one edge strip separated from the web at the one of the end of the dryer section or downstream of the dryer section.

25. The machine in accordance with claim 21, wherein the at least one edge strip removing device includes at least one scraper and the process further comprises guiding the at least one edge strip into a machine base with the at least one scraper.

26. A machine for producing a web, comprising:

a former for sheet formation of the web;

a press section for dewatering the web;

a drying section for drying the web;

at least two belts arranged on to form a press nip, wherein the web is arranged between said at least two belts through said press nip;

at least one edge strip forming device positioned after said press nip, relative to a belt travel direction, which is arranged to separate at least one edge strip from the web.

27. The machine in accordance with claim 26, wherein said at least one edge strip forming device is positioned in an area at an end of said press section.

28. The machine in accordance with claim 26, wherein said at least one edge strip forming device is positioned in an area at a beginning of said drying section.

29. The machine in accordance with claim 26, further comprising:

at least one edge strip removing device comprising a doctor positioned after said press nip, which is arranged to remove the at least one edge strip separated from the web.

30. A process of producing a web in an apparatus that includes a former, a press section, a drying section, at least one edge strip forming device, and at least two belts arranged to form a press nip, the process comprising:

forming the web on the former;

dewatering the web in the press section;

drying the web in the drying section;

pressing the web between the at least two belts in the press nip; and separating, with the at least one edge strip forming device, at least one edge strip from the web after the press nip, relative to a belt travel direction.

31. The process in accordance with claim 30, wherein the separating occurs in an area at an end of the press section.

32. The process in accordance with claim 30, wherein the separating occurs in an area at a beginning of the drying section.

33. A process of producing a web in an apparatus that includes a former, a press section, a drying section, and at least two belts arranged to form a press nip, the process comprising:

forming the web on the former;

dewatering the web in the press section;

drying the web in the drying section;

pressing the web between the at least two belts in the press nip;

separating at least one edge strip from the web after the press nip, relative to a belt travel direction.

* * * * *